US007789769B2

(12) United States Patent
Sugimoto

(10) Patent No.: US 7,789,769 B2
(45) Date of Patent: Sep. 7, 2010

(54) GOLF CLUB

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 2 days.

(21) Appl. No.: 12/007,929

(22) Filed: Jan. 17, 2008

(65) Prior Publication Data

US 2008/0261716 A1 Oct. 23, 2008

(30) Foreign Application Priority Data

Apr. 18, 2007 (JP) ..... 2007-109107
Oct. 23, 2007 (JP) ..... 2007-274594

(51) Int. Cl.
*A63B 53/02* (2006.01)

(52) U.S. Cl. ..... 473/307; 473/309

(58) Field of Classification Search ..... 473/288, 473/307, 309–311; 403/319; 285/89, 92
See application file for complete search history.

(56) References Cited

U.S. PATENT DOCUMENTS 1,019,657 A * 3/1912 Kerr ..... 279/93
1,650,183 A * 11/1927 Brooks ..... 473/296
3,524,646 A * 8/1970 Wheeler ..... 473/288
4,664,382 A * 5/1987 Palmer et al. ..... 473/288
4,854,582 A * 8/1989 Yamada ..... 473/309
4,895,368 A * 1/1990 Geiger ..... 473/307
5,496,029 A * 3/1996 Heath et al. ..... 473/296
5,588,921 A * 12/1996 Parsick ..... 473/299
6,620,054 B2 * 9/2003 Tseng ..... 473/306
6,890,269 B2 * 5/2005 Burrows ..... 473/307
2004/0018887 A1 * 1/2004 Burrows ..... 473/307
2005/0049072 A1 * 3/2005 Burrows ..... 473/305
2006/0293115 A1 12/2006 Hocknell et al.
2007/0078026 A1 * 4/2007 Holt et al. ..... 473/305
2007/0117645 A1 * 5/2007 Nakashima ..... 473/288
2007/0265106 A1 * 11/2007 Burrows ..... 473/307
2008/0280693 A1 * 11/2008 Chai ..... 473/288
2009/0239676 A1 * 9/2009 Bennett et al. ..... 473/288

* cited by examiner

*Primary Examiner*—Stephen L. Blau
(74) *Attorney, Agent, or Firm*—Birch, Stewart, Kolasch & Birch, LLP

(57) ABSTRACT

Golf club 2 has shaft 6, head 4, inner member 8 and cap 10. The head 4 has hosel member 22, and this hosel member 22 screw member 26 formed on the outer peripheral face thereof, and hosel hole 28. The cap 10 has screw member 40 formed on the inner peripheral face thereof, and internal extending portion 44 that extends more inwards than this screw member 40. The screw member 26 of this cap 10 and the screw member 40 of the hosel member 22 are bound by thread connection. The inner member 8 has shaft channel 46, and engaging face 50. The shaft 6 is stuck to the shaft channel 46. Engagement of the engaging face 50 with the internal extending portion 44 controls upward displacement of the inner member 8 with respect to the hosel hole 28.

6 Claims, 12 Drawing Sheets

22 (26)

GOLF CLUB

This application claims priority on Patent Application No. 2007-109107 filed in JAPAN on Apr. 18, 2007, and Patent Application No. 2007-274594 filed in JAPAN on Oct. 23, 2007. The entire contents of these Japanese Patent Applications are hereby incorporated by reference.

BACKGROUND OF THE INVENTION

1. Field of the Invention

The present invention relates to a golf club.

2. Description of the Related Art

In aspects of development and sales of golf clubs, evaluations of head performance and shaft performance have been made. Methods of these evaluations involve hitting by a tester, hitting with a swing robot, and the like.

When comparison of shaft performances is intended, a head attached to this shaft is preferably of the same kind. By using the heads of the same kind, influences from the difference in the head can be minimized, whereby the shaft performance can be accurately compared. For example, when three kinds of shafts are subjected to a comparative test, the heads of the same kind are attached to the three kinds of the shafts, respectively, and then the comparative test is carried out.

However, even though the heads of the same kind are used, there exit inevitably variances of performances among these heads in a strict sense. In order to compare the shaft performance more accurately, it is preferred to conduct the test with the identical head to be sequentially attached to each shaft.

The same is applied to the comparative test of head performances. Even though the shafts of the same kind are attached to the heads, respectively, there exit inevitably variances of performances among these shafts in a strict sense. In order to compare the head performance more accurately, it is preferred to conduct the test with the identical shaft to be sequentially attached to each head.

Therefore, when the head performances and shaft performances are evaluated, it is preferred that attachment/detachment of the shaft and the head can be easily conducted.

Ease in attachment/detachment of the head and shaft can be beneficial in a variety of aspects. When the attachment/detachment can be easily conducted, golf players can easily change the shaft or the head by themselves. For example, the golf player who cannot feel satisfaction with performances of purchased golf club can easily change by oneself the shaft or the head. In addition, easy construction of an original golf club including a desired head in combination with a desired shaft is enabled by the golf players themselves. The golf players may purchase a desired head and a desired shaft, and can themselves construct with these parts. The head and shaft which can be easily attached/detached enables custom fabrication of the golf club.

In general, the head and the shaft are adhered with an adhesive. For separation of the adhered head and shaft, it is necessary to pull the shaft out from the shaft hole by a strong external force while allowing for thermal degradation of the adhesive by heating the joint portion at a high temperature. This operation requires efforts, equipments and time. Additionally, during heating or pulling out, the shaft or the head can be damaged. Accordingly, attachment/detachment of the head and the shaft is not easy in general.

In view of the foregoings, United States Patent Application Serial No. US2006/0293115 A1 discloses a structure in which attachment/detachment of the head and the shaft is facilitated.

SUMMARY OF THE INVENTION

In the structure described in the above document, a screw is inserted from the bottom face of the sole, and the head and the shaft are stuck by this screw. The head necessitates a particular structure having a through-hole that penetrates to the sole face. The structure described in the document is inferior in versatility since it can be applied only to the head having this particular structure with limitation. Additionally, the structure described in the above document is complicated.

An object of the present invention is to provide a golf club having a simple structure that facilitates attachment/detachment of the shaft and the head.

The golf club according to the present invention has a shaft, a head, an inner member and a cap. The head has a hosel member. This hosel member has a screw member formed on the outer peripheral face thereof, and a hosel hole. The cap has a screw member formed on the inner peripheral face thereof, and an internal extending portion that extends more inwards than this screw member. The screw member of this cap and the screw member of the hosel member are bound by thread connection. The inner member has a shaft channel provided so as to open on the top end side, and an engaging face. At least a part of the inner member is inserted in the hosel hole. The shaft and the shaft channel are stuck by adhesion and/or fitting. The internal extending portion is engaged directly or indirectly with the engaging face, and this engagement controls upward displacement of the inner member with respect to the hosel hole.

Preferably, the golf club is constructed such that the thread connection enables the internal extending portion to press the engaging face directly or indirectly in a downward direction.

Preferably, the top end face of the inner member corresponds to the engaging face.

Preferably, the hosel member has a chipped portion extending downward from the top end face. Preferably, the inner member has an engaging protruding part engaged with the chipped portion.

Preferably, the golf club further has an adjacent member that is adjacent to the cap. Preferably, this adjacent member has an intervening portion that is positioned between the internal extending portion of the cap and the shaft. Preferably, this adjacent member a covering portion that is integrated with the intervening portion and covers at least a part of the top face of the cap.

According to the present invention, a golf club can be provided having a simple structure that facilitates attachment/detachment of the shaft and the head.

DESCRIPTION OF THE PREFERRED EMBODIMENTS

Hereinafter, the present invention will be explained in detail by way of preferred embodiments with appropriate reference to the accompanying drawings. Herein, terms indicating top and bottom positions/directions such as "top end", "upward", "bottom end", "downward", and the like are used. Herein, the term "top or up" means the upper side in the direction along the shaft axis line Z1, in other words, it means the shaft rear end side, or the grip side of a golf club. Further, the term "bottom or down" means the down side in the direction along the shaft axis line Z1, in other words, it means the sole side of the head. Also, unless otherwise mentioned particularly, "axis direction" herein means the direction along the shaft axis line Z1, while "circumferential direction" means the circumferential direction with respect to this axis direction, and "radial direction" means a direction that is perpendicular to the aforementioned axis direction.

Figure 2:
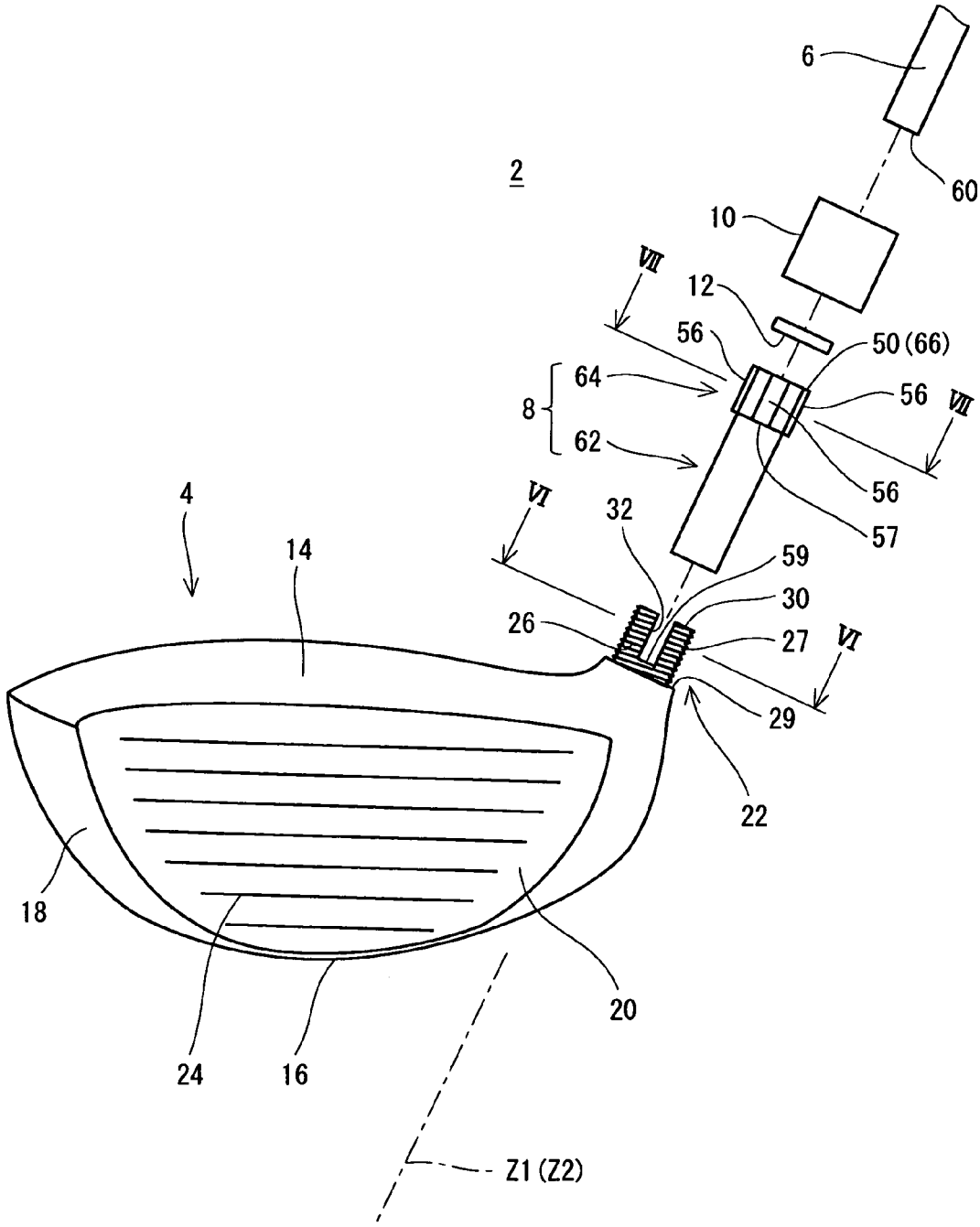
FIG. 2 shows an exploded view illustrating the golf club shown in FIG. 1.

Golf club 2 has head 4 and shaft 6. The head 4 is attached to one end of the shaft 6. Although not shown in the figure, a grip is attached to the other end of the shaft 6. Further, as shown in FIG. 2, the golf club 2 has inner member 8, cap 10 and washer 12. The inner member 8, the cap 10 and the washer 12 are members for sticking the head 4 with the shaft 6.

The head 4 is a wood golf club head. The head 4 has crown member 14, sole member 16, side member 18, face member 20 and hosel member 22. The head 4 is hollow. Face lines 24 are provide on the face member 20. The head 4 may be an iron golf club head, or any other type of head.

The hosel member 22 has screw member 26 and hosel hole 28. The screw member 26 is provided on the top end part of the hosel member 22. The screw member 26 is male threaded. The screw member 26 is formed on the outer peripheral face of the hosel member 22. The top end part of the hosel member 22 is formed to provide a cylindrical member 27. A screw member 26 is provided on the outer peripheral face of this cylindrical member 27. There exists step face 29 at the boundary between noncylindrical member and the cylindrical member 27 of the hosel member 22.

Figure 1:
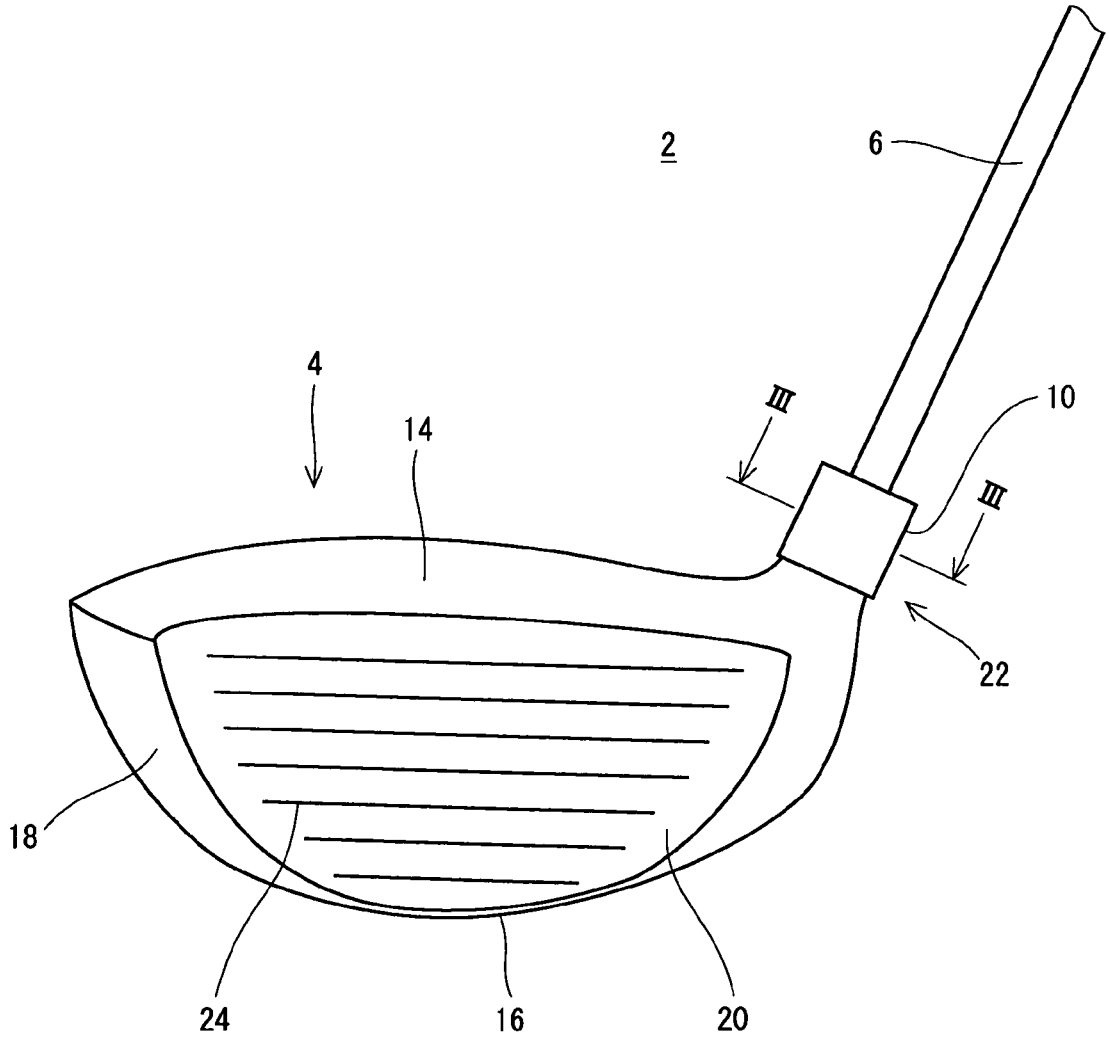
FIG. 1 shows a view illustrating a golf club according one embodiment of the present invention.
Figure 3:
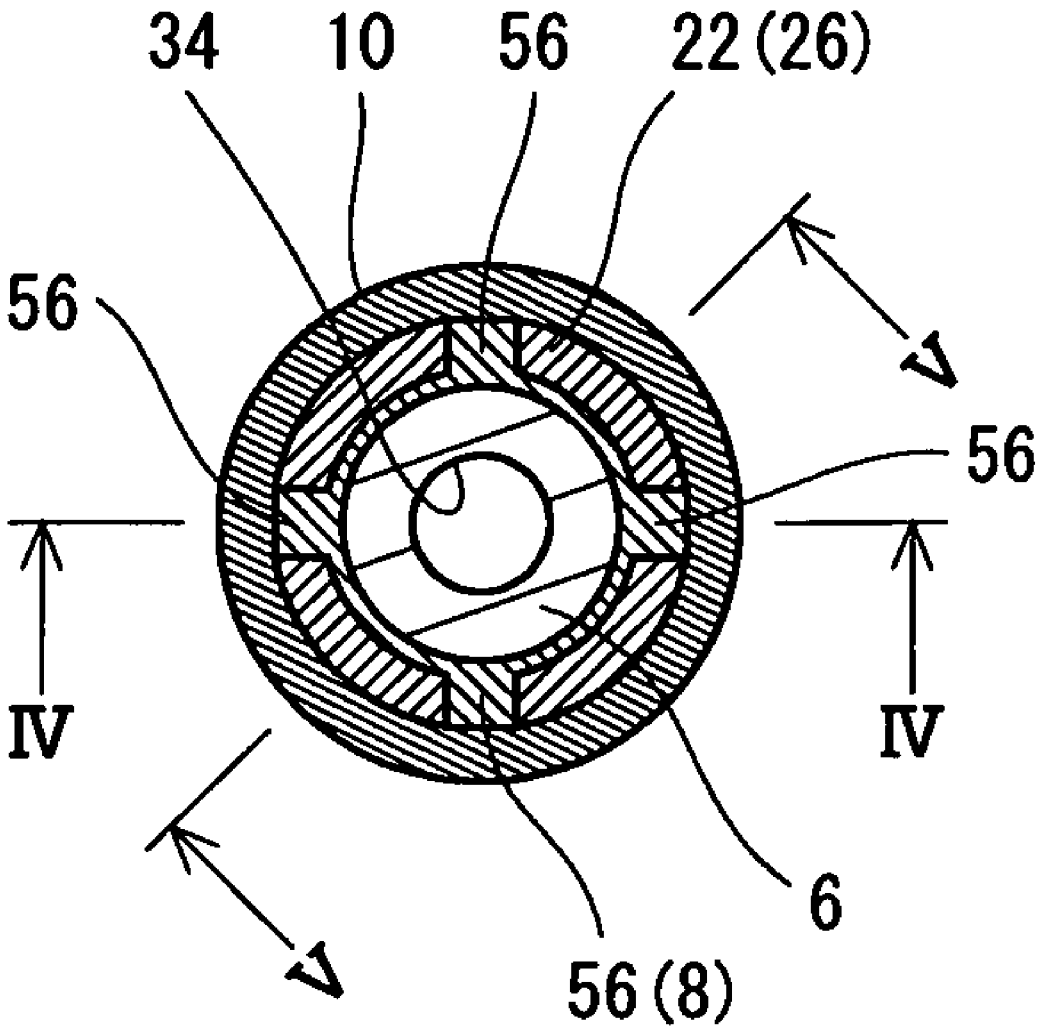
FIG. 3 shows a cross-sectional view taken along line III-III in FIG. 1.
Figure 4:
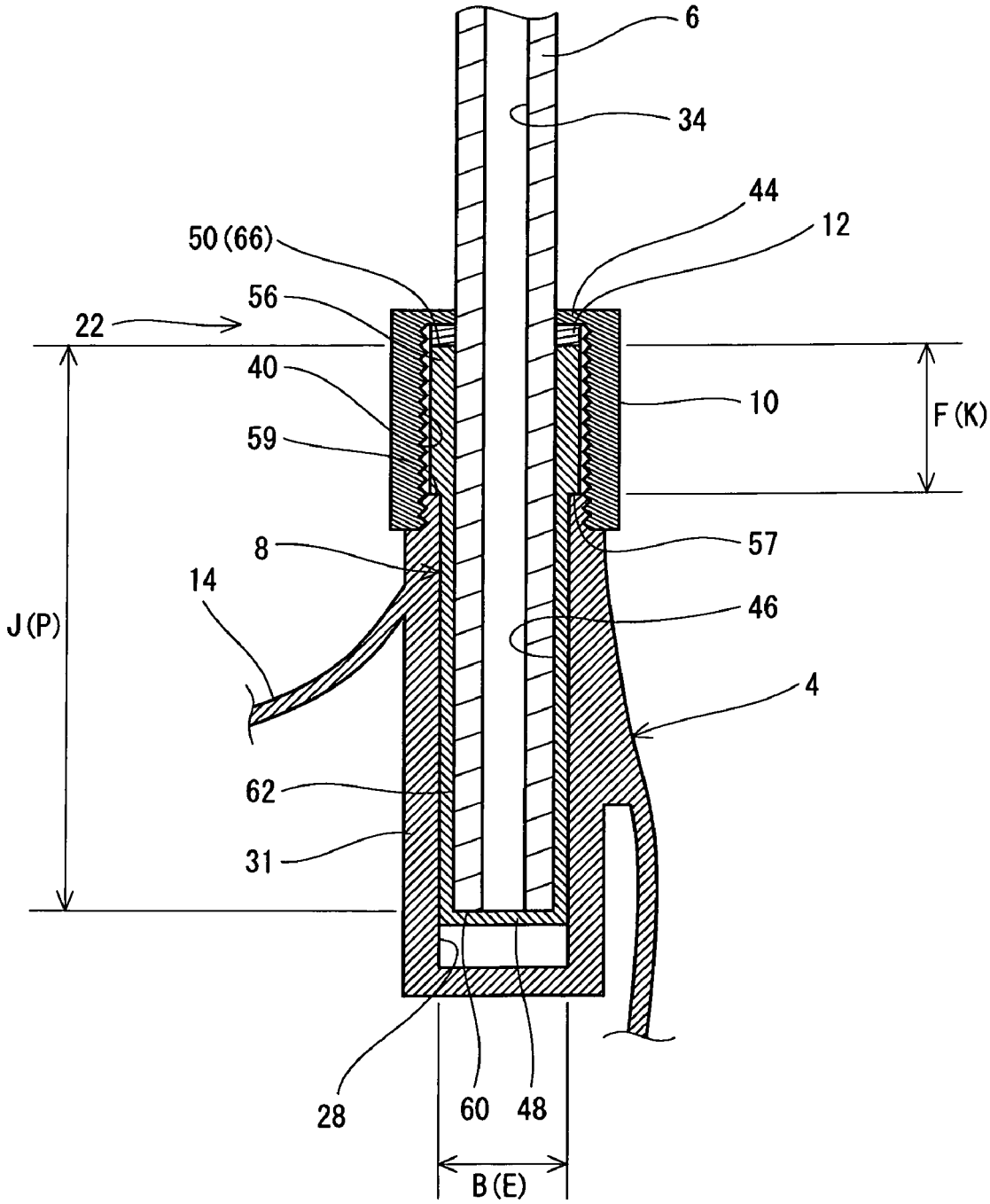
FIG. 4 shows a cross-sectional view of the golf club taken along line IV-IV in FIG. 3.
Figure 5:
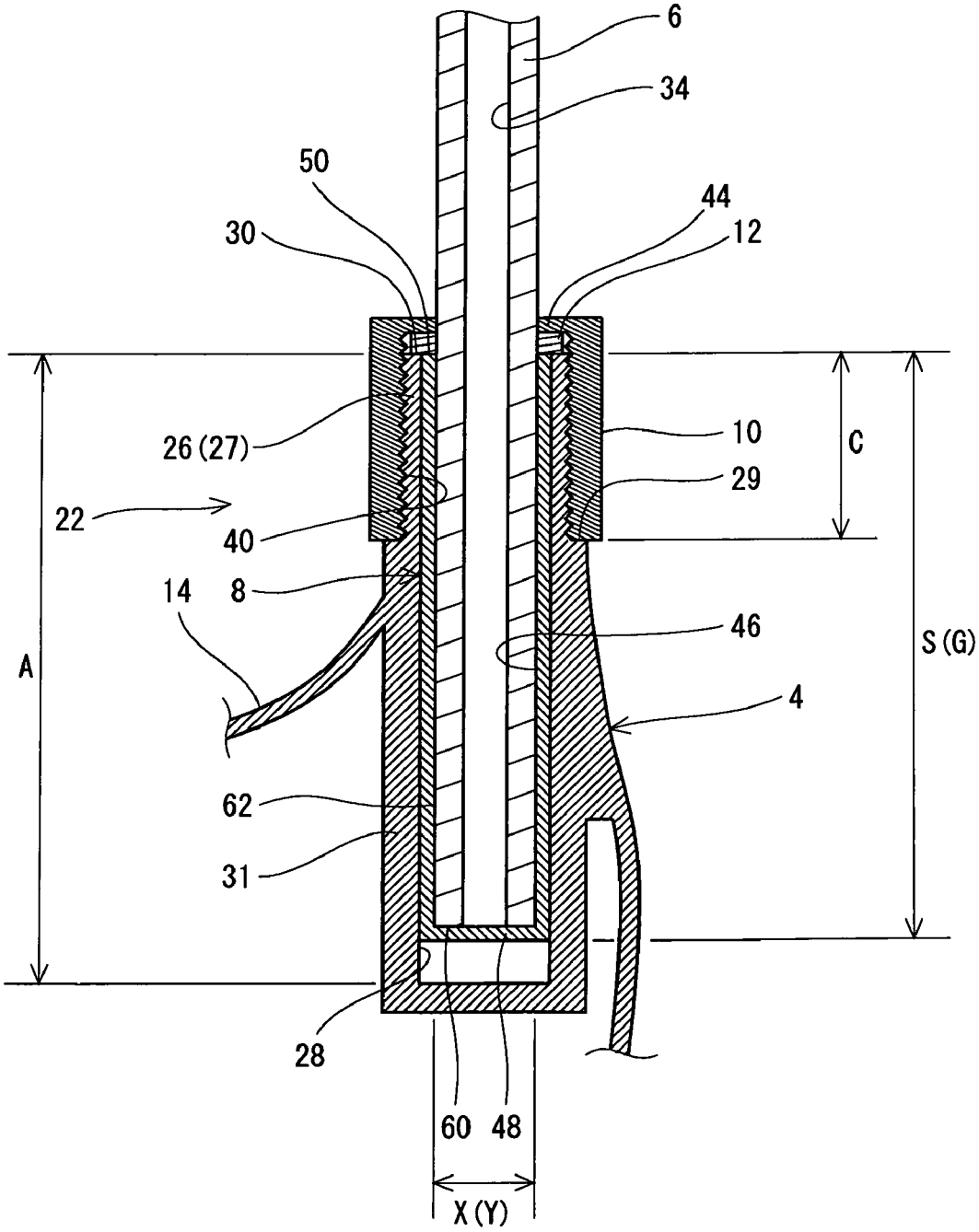
FIG. 5 shows a cross-sectional view of the golf club taken along line V-V in FIG. 3.
Figure 6:
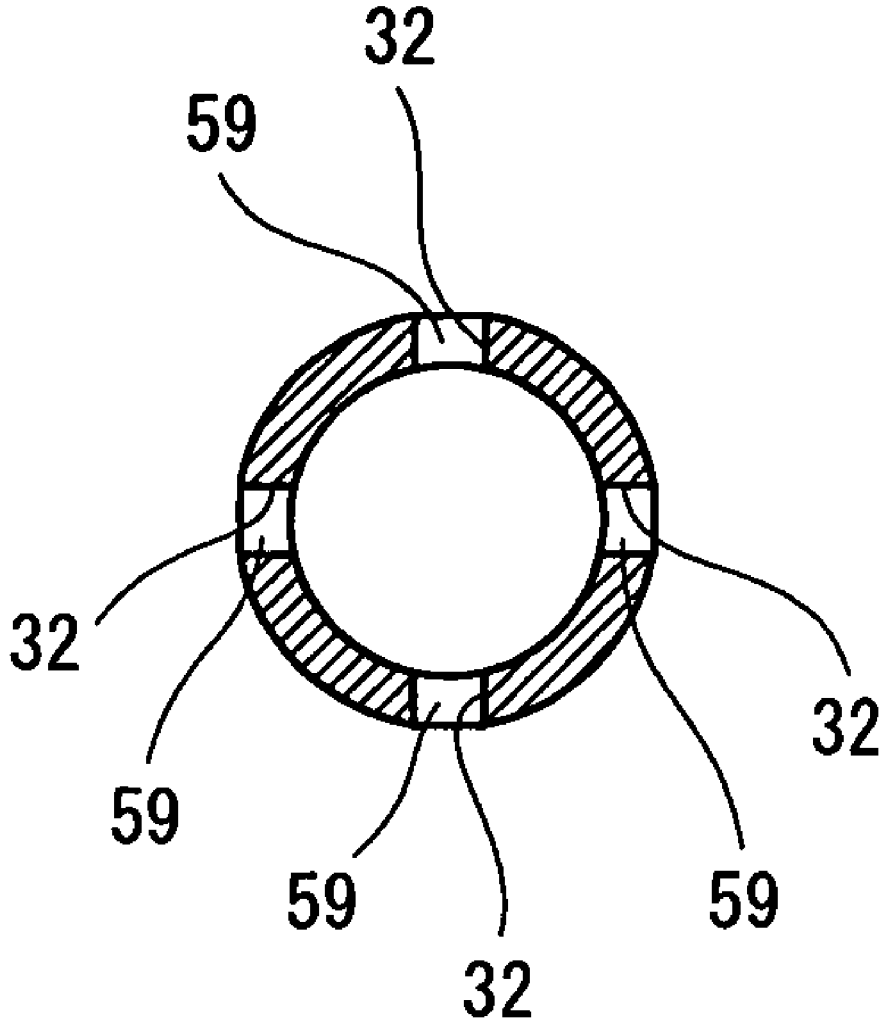
FIG. 6 shows a cross-sectional view taken along line VI-VI in FIG. 2.
Figure 7:
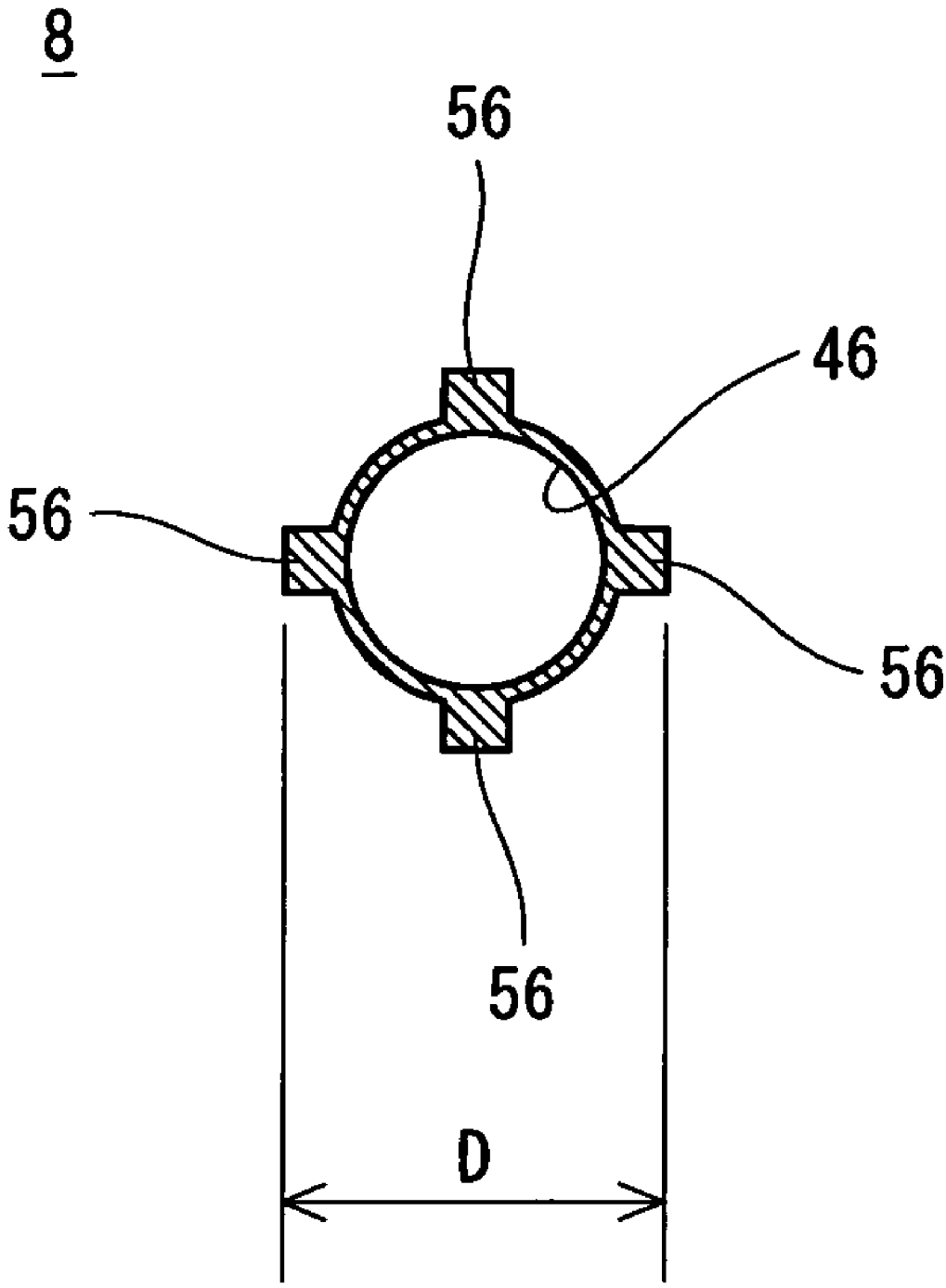
FIG. 7 shows a cross-sectional view taken along line VII-VII in FIG. 2.
Figure 8:
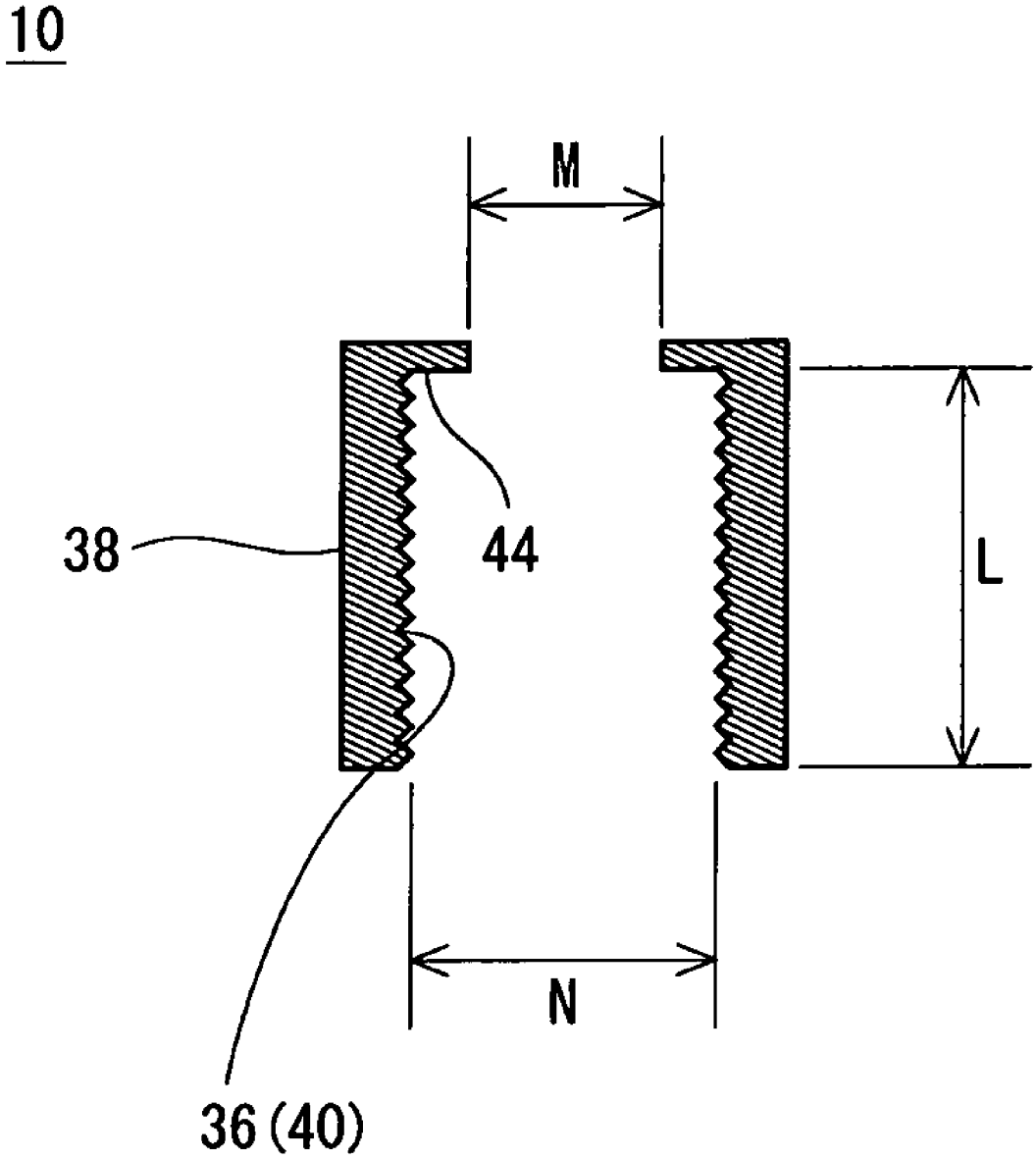
FIG. 8 shows a cross-sectional view of a cap.
Figure 9:
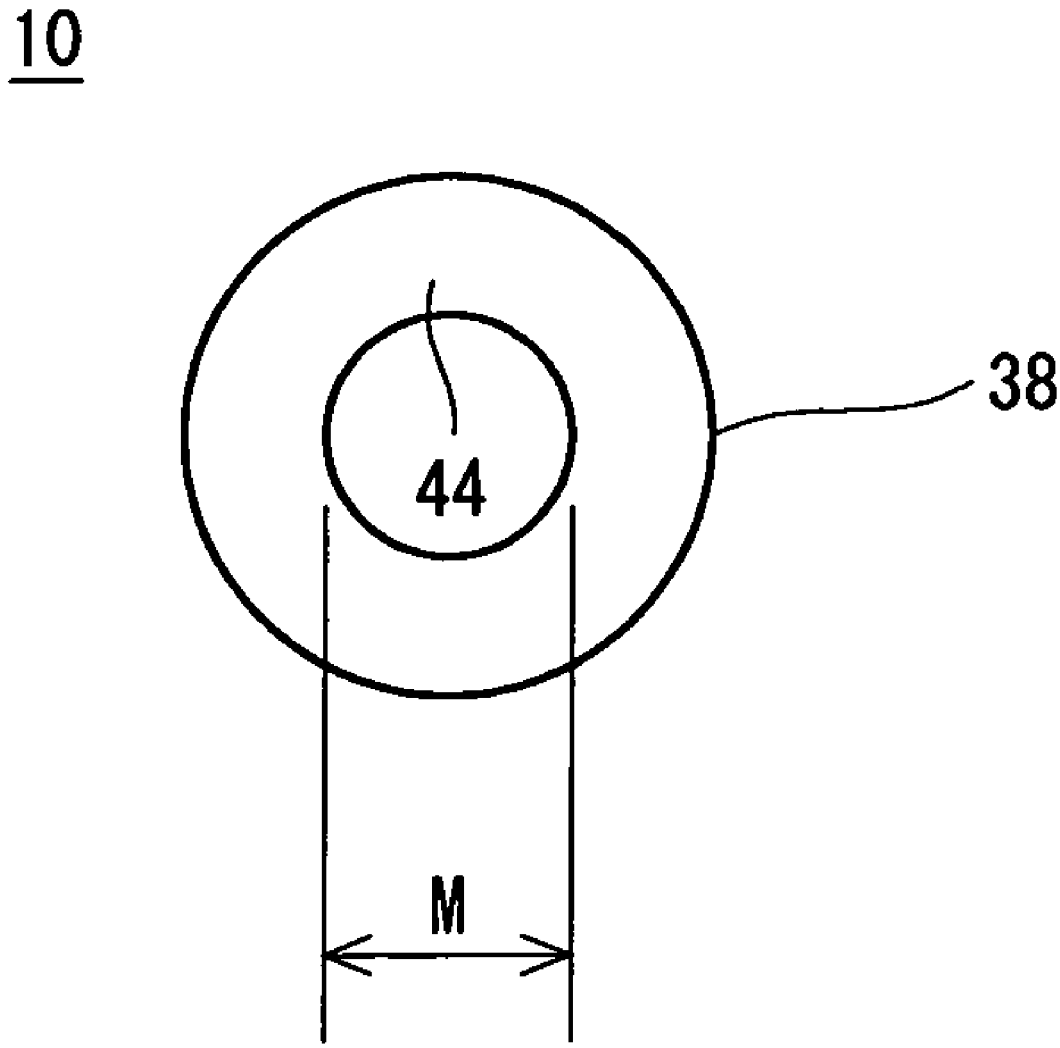
FIG. 9 shows a top view of a cap.

FIG. 3 shows a cross-sectional view taken along line III-III in FIG. 1; FIG. 4 shows a cross-sectional view of the golf club 2 taken along line IV-IV in FIG. 3; and FIG. 5 shows a cross-sectional view of the golf club 2 taken along line V-V in FIG. 3. FIG. 6 shows a cross-sectional view taken along line VI-VI in FIG. 2. FIG. 6 shows a cross-sectional view of the hosel member 22 alone. FIG. 7 shows a cross-sectional view taken along line VII-VII in FIG. 2. FIG. 7 shows a cross-sectional view of the inner member 8 alone. FIG. 8 shows a cross-sectional view of the cap 10. FIG. 9 shows the cap 10 viewed from above. For the purpose of providing views that are readily understandable, the cross-sectional shape of the screw member is not considered in FIG. 3 and FIG. 6.

As shown in FIG. 5, a part of the hosel hole 28 is formed with the cylindrical member 27. More specifically, the inner peripheral face of the cylindrical member 27 forms the top end part of the hosel hole 28. Moreover, the hosel hole 28 extends downward in the direction along the shaft axis line Z1. Inside the head 4 is provided a hole forming part 31 for forming the hosel hole 28. The cross-sectional shape of the hosel hole 28 on the cross section in the perpendicular direction to the shaft axis line Z1 is circular.

As shown in FIG. 2, the hosel member 22 has chipped portion 32 that extends downward from the top end face 30 thereof. The chipped portion 32 is a portion where the hosel member 22 is not present. The chipped portion 32 is present only at the cylindrical member 27. As shown in FIG. 6, the chipped portion 32 is provided equally spaced in the circumferential direction of the cylindrical member 27. The chipped portion 32 is provided every 90 degrees in the circumferential direction of the cylindrical member 27. The chipped portion 32 is provided at four sites.

The chipped portion 32 extends parallel to the shaft axis line Z1. The width of the chipped portion 32 is even. In other words, the width of the chipped portion 32 (width in the circumferential direction) is identical at every location in the direction along the shaft axis line Z1.

As shown in FIG. 4 and FIG. 5, the shaft 6 is tubular, and has an apparently circular cylindrical shape. The shaft 6 includes a hollow part 34 therein. This hollow part 34 is open downwards.

The cap 10 has a circular cylindrical shape. The cap 10 has a hollow space therein. As shown in FIG. 8, the cap 10 has inner peripheral face 36 and outer peripheral face 38. The outer peripheral face 38 of the cap 10 corresponds to a circumference face. A screw member 40 is formed on the inner peripheral face 36. This screw member 40 is female threaded. The cap 10 has internal extending portion 44 that extends more inwards than the screw member 40. The internal extending portion 44 is disposed upper side than the screw member 40. The internal extending portion 44 is disposed at the top end part of the cap 10. The internal extending portion 44 has an annular shape. The internal diameter M of the internal extending portion 44 is smaller than the internal diameter N of the screw member 40. As shown in FIG. 5, the screw member 40 of the cap 10 and the screw member 26 of the hosel member 22 are bound by thread connection. In other words, the screw member 40 and the screw member 26 are threadably engaged. In this manner, the cap 10 and the head 4 are connected by a screw mechanism. The outer peripheral face 38 of the cap 10 may have a noncircular cross-sectional shape. For example, the cross-sectional shape of the outer peripheral face 38 may have a straight line on at least a part thereof. For example, the cross-sectional shape of the outer peripheral face 38 may be a polygon such as a hexagon. By providing the outer peripheral face 38 having a noncircular cross-sectional shape, the cap 10 can be easily turned when the thread connection is allowed.

The screw member 40 and the screw member 26 are constructed such that they are tightened with each other by a force imparted from the ball upon hitting. The head 4 is for right-handed players. When the head 4 is for right-handed players, the head 4 is going to rotate in the right-hand direction viewed from the top side (grip side) around the shaft axis line as a center, by the force received from the ball upon hitting. The screw member 40 and the screw member 26 are constructed to be fastened by this rotation. When the cap 10 is rotated in the left-hand direction viewed from the top side (grip side), the screw member 40 and the screw member 26 are fastened. To the contrary, when the cap 10 is rotated in the right-hand direction viewed from the top side (grip side), the fastening of the screw member 40 and the screw member 26 is loosen. Thus, the screw member 40 and the screw member 26 form a left hand screw.

Accordingly, in the case of the golf club for right-handed players, the screw member 40 and the screw member 26 preferably form a left hand screw. By constructing the left hand screw, loosening of the thread connection due to the impact upon hitting is suppressed. In light of suppression of loosening of the thread connection due to the impact upon hitting, the screw member 40 and the screw member 26 form a right hand screw when the golf club is for left-handed players.

The washer 12 is a ring. The external diameter of the washer 12 is substantially identical with the internal diameter N of the cap 10. The internal diameter of the washer 12 is substantially the same as the external diameter of the shaft 6 at the tip part. In tightening of the screw, relative rotation of the inner member 8 and the cap 10 may damage the inner member 8. The washer 12 can inhibit the damage of the inner member 8. The washer 12 may or may not be present. The substantially same internal diameter of the washer 12 as the external diameter of the shaft 6 at the tip part even further ensures the engagement of the washer 12 and the engaging face 50 described later.

As shown in FIG. 4 and FIG. 5, the inner member 8 has shaft channel 46, bottom member 48, and engaging face 50. The engaging face 50 is the top end face of the inner member 8. In the inner member 8, the shaft channel 46 is open upwards. The shaft channel 46 extends from the top end face of the inner member 8 to the bottom member 48. The inner member 8 is integrated as a whole. The integrated inner member 8 has a high strength.

As shown in FIG. 4 and FIG. 5, the shaft 6 is inserted into the shaft channel 46. The shaft channel 46 and the shaft 6 are stuck by adhesion. In other words, the inner peripheral face of the shaft channel 46 is adhered with the outer peripheral face of the shaft 6. An adhesive is used for the adhesion. Alternatively, the shaft channel 46 and the shaft 6 may be stuck by fitting. The adhesion with an adhesive may be employed in combination with fitting.

The engaging face 50 can be engaged directly or indirectly with the internal extending portion 44 of the cap 10. In this embodiment, the engaging face 50 is indirectly engaged with the internal extending portion 44 via a washer 12. This engagement controls displacement of the inner member 8 upward in the axis direction with respect to the cap 10. This engagement prevents the inner member 8 from removal from the hosel hole 28.

As shown in FIG. 1, the inner member 8 is not visually recognized from the outside of the golf club 2. The inner member 8 is masked by the shaft 6, the cap 10 and the head 4.

At least a part of the inner member 8 is inserted into the hosel hole 28. In this embodiment, whole of the inner member 8 is inserted into the hosel hole 28. By the insertion into the hosel hole 28, the inner member 8 is held by the hosel hole 28. The inner member 8 and the hosel hole 28 are not adhered.

The tip part of the shaft 6 is inserted into the shaft channel 46, and thus located inside the hosel hole 28. In other words, the shaft 6 has a part positioned inside the hosel hole 28 while being inserted into the shaft channel 46. According to this construction, the shaft 6 is held by the shaft channel 46, and is also supported concomitantly by the hosel hole 28. This construction allows the stress that acts on the tip part of the shaft 6 to be received by the hosel hole 28. Therefore, deformation of the shaft channel 46 and the shaft 6 can be inhibited. As a result, the sticking between the shaft 6 and the shaft channel 46 becomes likely to be kept, and the inner member 8 becomes resistant to the removal from the hosel hole 28.

Furthermore, the inner member 8 has engaging protruding part 56. The engaging protruding part 56 is provided at the top end part of the inner member 8. The engaging protruding part 56 is provided on the external surface of the inner member 8. As shown in FIG. 7, the engaging protruding part 56 is protruded outwards in the radial direction. The engaging protruding part 56 is positioned at the chipped portion 32. The engaging protruding part 56 is inserted into the chipped portion 32. The engaging protruding part 56 and the chipped portion 32 are engaged. The shape of the engaging protruding part 56 corresponds to the shape of the chipped portion 32. The positioning of the engaging protruding part 56 corresponds to the chipped portion 32. Similarly to the chipped portion 32, the engaging protruding part 56 is positioned equally spaced in the circumferential direction. The engagement of the engaging protruding part 56 and the chipped portion 32 controls relative rotation (relative rotation in the circumferential direction) of the inner member 8 and the hosel member 22 of the head 4. In light of control of the relative rotation of the hosel member 22 and the inner member 8, the engaging protruding part 56 may be preferably fitted with the chipped portion 32. In light of suppression of the relative rotation of the hosel member 22 and the inner member 8, the engaging protruding part 56 and the chipped portion 32 are fitted such that there exists no gap in the circumferential direction. At least one engaging protruding part 56 may be present. Also, at least one chipped portion 32 may be present.

The chipped portion 32 and the engaging protruding part 56 also play a role as a stopper that controls the insertion length S of the inner member 8 with respect to the hosel hole 28 (see, FIG. 5). More specifically, engagement of the bottom end 57 of the engaging protruding part 56 with the bottom end 59 of the chipped portion 32 (see, FIG. 4), controls the insertion length S of the inner member 8.

As shown in FIG. 4 and FIG. 5, there exists a void space k1 between the bottom member 48 of the inner member 8 and the bottom member 61 of the hole forming part 31. The presence of this void space k1 leads to the control of the insertion length S of the inner member 8 only by abutment of the bottom end 59 of the chipped portion 32 with the bottom end 57 of the engaging protruding part 56.

The control of the insertion length S may be also achieved by combining the following (abutment a) and (abutment b). Alternatively, only (abutment b) may be present without (abutment a) being present:

(abutment a): abutment of the bottom end 57 of the engaging protruding part 56 with the bottom end 59 of the chipped portion 32;

(abutment b): abutment of the bottom member 48 of the inner member 8 with the bottom member 61 of the hole forming part 31.

However, when the (abutment a) is used in combination with the (abutment b), imbalance of abutment pressure of the (abutment a) and abutment pressure of the (abutment b) is likely to be caused unless extremely high dimensional accuracy is achieved. This imbalance may rather result in insufficient fixation of the inner member 8 as compared with the case in which either one of the (abutment a) or the (abutment b) alone is employed. Also, when (abutment a) is used in combination with (abutment b), the abutment pressure is dispersed in both directions, whereby the abutment pressure of the (abutment a) may be decreased. The engaging protruding part 56 not only controls the insertion length S, but also plays a part in controlling the relative rotation of the inner member 8 and the hosel hole 28. Therefore, when the abutment pressure of the (abutment a) is decreased, the effect of controlling the relative rotation of the inner member 8 and the hosel hole 28 may be also reduced. Accordingly, from the viewpoint to ensure the fixation of the inner member 8, and suppression of positional displacement of the shaft 6, use in combination of the (abutment a) and the (abutment b) is not preferred. Furthermore, as in the aforementioned embodiment, to incorporate the (abutment a) but not the (abutment b) is more preferred. In this respect, it is preferable to have the void space k1 present.

As described above, the inner member 8 has the engaging face 50. This engaging face 50 constitutes a plane perpendicular to the center axis line Z2 of the inner member 8. The center axis line Z2 of the inner member 8 agrees with the shaft axis line Z1.

As described above, the engaging face 50 constitutes the top end face of the inner member 8 in this embodiment. Also, the engaging face 50 may not constitute the top end face of the inner member 8. For example, a step face may be provided at the intermediate position along the longitudinal direction of the inner member 8 on the external surface of the inner member 8, and this step face may serve as the engaging face.

The end face 60 of the bottom end of the shaft 6 abuts on the bottom member 48 of the inner member 8. This abutment can maximize the insertion length of the shaft 6 with respect to the shaft channel 46, whereby the abutment area of the inner member 8 with the shaft 6 can be enlarged. Accordingly, sticking of the shaft 6 with the inner member 8 can be even more ensured. Also, the end face 60 may not abut the bottom member 48.

As shown in FIG. 2, the inner member 8 has a circumference face part 62 and an engaging part 64. The circumference face part 62 corresponds to a part the external surface of which is a circumference face. The engaging part 64 is a part where the engaging protruding part 56 is arranged on the external surface. The boundary between the circumference face part 62 and the engaging part 64 corresponds to the bottom end 57 of the engaging protruding part 56. The engaging part 64 is positioned upside the circumference face part 62. The top end face of the engaging part 64 corresponds to the engaging face 50.

Due to the presence of the engaging face 50, the top end face of the inner member 8 is provided with outward extending face 66 that extends in the radial direction on the external side with respect to the circumference face part 62 (see, FIG. 4). The outward extending face 66 corresponds to a part of the engaging face 50. This outward extending face 66 corresponds to the top end face of the engaging protruding part 56. Due to this outward extending face 66, the inner member 8 becomes more likely to be engaged with the internal extending portion 44. The engaging protruding part 56 plays a role in widening the engaging face 50. The engaging protruding part 56 can further ensure the engagement of the inner member 8 with the cap 10. Moreover, the presence of this engaging protruding part 56 is enabled by the chipped portion 32. The chipped portion 32 secures a space for providing the engaging protruding part 56.

As shown in FIG. 4 and FIG. 5, the internal extending portion 44 of the cap 10 is engaged with the engaging face 50 of the inner member 8. This engagement may be either direct or indirect. This engagement controls upward displacement of the inner member 8 with respect to the hosel hole 28. This engagement prevents coming out of the inner member 8 from the hosel hole 28.

In this embodiment, the internal extending portion 44 and the engaging face 50 are indirectly engaged. More specifically, the internal extending portion 44 and the engaging face 50 are engaged via the washer 12. The internal extending portion 44 and the engaging face 50 may be directly engaged. The internal diameter M of the internal extending portion 44 (see, FIG. 8) is approximately equal to the shaft external diameter at the bottom end of the shaft 6. Accordingly, the internal diameter M is set to be a minimum value in the range not to interfere with the shaft 6. Thus, the engagement of the internal extending portion 44 with the engaging face 50 is even more secured. The internal extending portion 44 may not be annular. For example, the internal extending portion 44 may be a projection.

As the cap 10 and the hosel member 22 are allowed to relatively rotate thereby screwing the screw member 40 into the screw member 26, the cap 10 is moved downward with respect to the hosel member 22. This movement leads to getting the internal extending portion 44 close to the engaging face 50. Further screwing results in the state in which the internal extending portion 44 directly or indirectly presses the engaging face 50 downward. This pressing can secure fixation of the inner member 8 to the hosel member 22. As shown in FIG. 4 and FIG. 5, the golf club 2 of this embodiment is constructed such that the internal extending portion 44 can indirectly press the engaging face 50. In this embodiment, the internal extending portion 44 presses the engaging face 50 via the washer 12. The internal extending portion 44 may directly press the engaging face 50. The length, placement and the like of each screw member is arbitrarily designed such that the internal extending portion 44 presses the engaging face 50 directly or indirectly.

As shown in FIG. 5, positions of the engaging face 50 and the hosel end face 30 along the axial direction are substantially the same in the aforementioned embodiment. However, the present invention is not limited to such an embodiment. For example, the position of the engaging face 50 along the axial direction may be on the upperside than the position of the hosel end face 30 along the axial direction. For example, when only a part of the inner member 8 is inserted in the hosel hole 28, the position of the engaging face 50 along the axial direction can be situated on the upperside than the position of the hosel end face 30 along the axial direction. The inner member 8 may have a part not inserted in the hosel hole 28.

In the aforementioned embodiment, a control mechanism of insertion length is provided for controlling the insertion length S of the inner member 8 with respect to the hosel hole 28. As described above, this control mechanism of insertion length is the engagement of the engaging protruding part 56 with the chipped portion 32 in this embodiment. Exemplary other control mechanism of insertion length may include a stopper that abuts the bottom end face of the inner member 8 provided on the bottom member of the hosel hole 28.

Such a control mechanism of insertion length can even further ensure fixation of the inner member 8 to the hosel member 22. More specifically, the inner member 8 can be supported by the control mechanism of insertion length from the underside, and can be pressed downward from the top side by the screw mechanism. Therefore, the inner member 8 will be in the state being held by the hosel member 22 and the cap 10, thereby being fixed to the head 4. Moreover, as described above, because the void space k1 is present, the (abutment a) is present but the (abutment b) is not present. Accordingly, pressurization force imparted by the screw mechanism does not spread on the (abutment b). Because the void space k1 is present, holding of the engaging protruding part 56 between the hosel member 22 and the cap 10 can be still further secured. By thus securing the holding of the engaging protruding part 56, the positional displacement of the inner member 8 in the circumferential direction is suppressed, and in addition, positional displacement of the inner member 8 in the vertical direction is also suppressed. In this manner, due to the presence of the void space k1, fixation of the shaft 6 can be still further secured.

As described above, the inner member 8 and the shaft 6 are stuck. Therefore, when the inner member 8 will be fixed on the head 4, the shaft 6 is fixed to the head 4. In addition, fixation of the head 4 with the shaft 6 can be easily released by loosening the screw mechanism.

As the assembly procedure of the golf club 2, the following procedure 1 or procedure 2 may be illustrated.

[Assembly Procedure 1]

This procedure includes the following steps (1) to (4).

(1) The shaft 6 is inserted through the cap 10 and the washer 12.

(2) The shaft is inserted into the shaft channel 46 of the inner member 8, and the shaft 6 and the inner member 8 are joined by an adhesive or the like.

(3) The inner member 8 is inserted into the hosel hole 28.

(4) The cap 10 is screwed with the hosel member 22.

[Assembly Procedure 2]

This procedure includes the following steps (1) to (4).

(1) The washer 12 and the inner member 8 are disposed in the cap 10.

(2) The shaft is inserted into the shaft channel 46 of the inner member 8, and the shaft 6 and the inner member 8 are joined by an adhesive or the like.

(3) The inner member 8 is inserted into the hosel hole 28.

(4) The cap 10 is screwed with the hosel member 22.

After perfecting assembly by the above procedure 1 or procedure 2, the shaft 6 can be readily attached and detached. In other words, the shaft 6 can be attached/detached by the screw mechanism with respect to the head 4. When the shaft 6 is soled as a part before being assembled, a member after subjecting to the steps (1) and (2) may be employed in the Assembly procedure 1 or 2.

The material of the head is not limited. Illustrative examples of the material of the head include titanium, titanium alloys, CFRP (carbon fiber reinforced plastic), stainless steel, Maraging steel, magnesium alloys, aluminum alloys, iron and the like. The head may be constituted with multiple materials. The head may include a head main body produced by casting that is joined with a face member produced by forging or pressing.

The structure of the head is not limited. The head may be integrally molded as a whole, or formed by joining multiple members. The method of manufacturing the head is not limited. Illustrative examples of the method of manufacturing the head include casting such as lost wax precision casting. The head has a projecting portion that can be thread connected with the cap.

The material of the shaft is not limited. Illustrative examples of the material of the shaft include CFRP (carbon fiber reinforced plastic) and metals. So-called carbon shafts and steel shafts can be suitably used. Additionally, the structure of the shaft is not also limited.

The material of the inner member is not limited. In light of suppression of increase in the club weight, the inner member is preferably light-weight. In this respect, the specific gravity of the inner member is preferably equal to or less than 4.6, and more preferably equal to or less than 4.5. In light of suppression of breakage upon impact of hitting, the inner member preferably has a high strength. In this respect, the material of preferable inner member may be aluminum, an aluminum alloy, titanium, a titanium alloy, magnesium, a magnesium alloy, CFRP (carbon fiber reinforced plastic), a resin or the like.

The material of the cap is not limited. In light of suppression of breakage by impact upon hitting, the cap preferably has a high strength. In this respect, the material of the cap is preferably a metal. In light of suppression of increase in the club weight, the cap is preferably light-weight. In this respect, the specific gravity of the cap is preferably equal to or less than 4.6, and more preferably equal to or less than 4.5. Taking into account these respects on the whole, more preferable material of the cap is aluminum, an aluminum alloy, titanium, a titanium alloy, magnesium, a magnesium alloy, CFRP (carbon fiber reinforced plastic), a resin, or the like.

The material of the washer is not limited. In light of suppression if increase in the club weight, the washer is preferably light-weight. In this respect, the specific gravity of the washer is preferably equal to or less than 4.6, and more preferably equal to or less than 4.5. In light of suppression of breakage upon impact of hitting, the washer preferably has a high strength. In this respect, the material of preferable washer may be aluminum, an aluminum alloy, titanium, a titanium alloy, magnesium, a magnesium alloy, CFRP (carbon fiber reinforced plastic), a resin or the like.

In FIG. 5, what is indicated by a both-oriented arrowhead A is the depth of the hosel hole 28. In light of securing the support of the inner member 8 by the hosel hole 28, the depth A is preferably equal to or greater than 20 mm, more preferably equal to or greater than 23 mm, and still more preferably equal to or greater than 28 mm. In light of suppression of increase in the weight of the hosel member, and excessive decrease in the center of gravity distance, the depth A is preferably equal to or less than 50 mm, more preferably equal to or less than 45 mm, and still more preferably equal to or less than 43 mm.

In FIG. 4, what is indicated by a both-oriented arrowhead B is the pore size of the hosel hole 28. In light of securing the support of the inner member 8 by the hosel hole 28, the pore size B is preferably equal to or greater than 5.0 mm, more preferably equal to or greater than 6.0 mm, and still more preferably equal to or greater than 8.0 mm. In light of suppression of increase in the weight of the hosel member, and excessive decrease in the center of gravity distance, the pore size B is preferably equal to or less than 17.0 mm, more preferably equal to or less than 15.0 mm, and still more preferably equal to or less than 12.0 mm.

In FIG. 5, what is indicated by a both-oriented arrowhead C is the length of the screw member 26 along the axial direction. In light of increase in the length of the screw member to enhance the fastening force of the screw mechanism, the length C is preferably equal to or greater than 5.0 mm, more preferably equal to or greater than 7.0 mm, and still more preferably equal to or greater than 10.0 mm. In light of preventing the center of gravity distance from becoming excessive small, and the center of gravity from becoming excessive high, the length C is preferably equal to or less than 20.0 mm, more preferably equal to or less than 17.0 mm, and still more preferably equal to or less than 15.0 mm.

In FIG. 7, what is indicated by a both-oriented arrowhead D is the maximum diameter of the inner member 8 at the engaging part 64. In light of suppression of relative rotation of the inner member 8 and the hosel member 22, and enhancing the strength of the inner member 8, the maximum diameter D is preferably equal to or greater than 7.0 mm, more preferably equal to or greater than 9.0 mm, and still more preferably equal to or greater than 10.0 mm. When the weight of the inner member 8 is excessively increased, the center of gravity position of the head portion including the head inner member 8 is apt to be excessively high or get closer to the heel. In light of suppression of increase in the weight of the inner member 8, the maximum diameter D is preferably equal to or less than 19.0 mm, more preferably equal to or less than 17.0 mm, and still more preferably equal to or less than 15.0 mm.

In FIG. 4, what is indicated by a both-oriented arrowhead E is the external diameter of the circumference face part 62 in the inner member 8. In light of improvement of the strength of the inner member 8, the external diameter E is preferably equal to or greater than 5.0 mm, more preferably equal to or greater than 6.0 mm, and still more preferably equal to or greater than 8.0 mm. When the external diameter E is too great, the pore size B of the hosel hole 28 becomes so large that the hosel member 22 is apt to be excessively heavy. In light of decrease in the weight of the hosel member 22, and preventing the center of gravity distance from becoming excessively small, the external diameter E is preferably equal to or less than 17.0 mm, more preferably equal to or less than 15.0 mm, and still more preferably equal to or less than 12.0 mm.

In light of securing the support of the inner member 8 by the hosel hole 28, it is preferred that the external diameter E of the circumference face part 62 be substantially identical with the pore size B of the hosel hole 28. Specifically, the external diameter E (mm) and the pore size B (mm) preferably follow the following formula of:

$$[B-0.20]\leqq E\leqq B.$$

In FIG. 4, what is indicated by a both-oriented arrowhead F is the length of the engaging protruding part 56 along the axial direction. In light of suppression of relative rotation of the inner member 8 and the hosel member 22, and enhancing the strength of the engaging protruding part 56, the length F is preferably equal to or greater than 5 mm, more preferably equal to or greater than 7 mm, and most preferably equal to or greater than 10 mm. When the weight of the inner member 8 is excessively increased, the position of the center of gravity of the head portion including the inner member 8 is apt to be excessively high or get closer to the heel. In light of suppression of increase in the weight of the inner member 8, the length F is preferably equal to or less than 20 mm, more preferably equal to or less than 17 mm, and most preferably equal to or less than 15 mm.

In FIG. 4, what is indicated by a both-oriented arrowhead K is the length of the chipped portion 32 along the axial direction. In light of suppression of relative rotation of the inner member 8 and the hosel member 22, the length K is preferably equal to or greater than 5 mm, more preferably equal to or greater than 7 mm, and most preferably equal to or greater than 10 mm. When the weight of the hosel member 22 is too great, the position of the center of gravity of the head 4 is apt to be excessively high or get closer to the heel. In light of suppression of increase in the weight of the hosel member 22, the length K is preferably equal to or less than 20 mm, more preferably equal to or less than 17 mm, and most preferably equal to or less than 15 mm.

When the top end face of the engaging protruding part 56 is located below the top end of the chipped portion 32, the engaging protruding part 56 is less likely to be pressed. In other words, when the top end face of the engaging protruding part 56 is located below the hosel end face 30, the engaging protruding part 56 is less likely to be pressed. In this respect, the length F of the engaging protruding part 56 along the axial direction is preferably no less than length K of the chipped portion 32 along the axial direction.

In FIG. 5, what is indicated by a both-oriented arrowhead G is the length of the inner member 8 along the axial direction. In light of improvement of the adhesion strength of the shaft 6 with the inner member 8, and increase in the insertion length S, the length G is preferably equal to or greater than 20 mm, more preferably equal to or greater than 23 mm, and most preferably equal to or greater than 28 mm. When the weight of the inner member 8 is excessively increased, the position of the center of gravity of the head portion including the inner member 8 is apt to be excessively high or get closer to the heel. In light of suppression of increase in the weight of the inner member 8, the length G is preferably equal to or less than 50 mm, more preferably equal to or less than 45 mm, and most preferably equal to or less than 43 mm.

In FIG. 9, what is indicated by a both-oriented arrowhead M is the internal diameter of the internal extending portion 44 in the cap 10. In light of preventing the tip part of the shaft 6 from becoming excessively thin to enhance the strength of the shaft 6, the internal diameter M is preferably equal to or greater than 5.0 mm, more preferably equal to or greater than 6.0 mm, and still more preferably equal to or greater than 7.0 mm. In light of preventing the tip part of the shaft 6 from becoming excessively thick to avoid hardening of the tip part of the shaft 6, the internal diameter M is preferably equal to or less than 12.0 mm, more preferably equal to or less than 11.0 mm, and still more preferably equal to or less than 10.0 mm.

In light of securing the engagement of the internal extending portion 44 with the engaging face 50 while permitting insertion of the shaft 6, it is preferred that this internal diameter M (mm) and the external diameter X (mm) of the shaft tip follow the following formula:

$$[M-0.50]\leqq X\leqq M.$$

In light of preventing the tip part of the shaft 6 from becoming excessively thin to thereby enhancing the strength of the shaft 6, the external diameter X (mm) of the shaft tip is preferably equal to or greater than 5.0 mm, more preferably equal to or greater than 6.0 mm, and still more preferably equal to or greater than 7.0 mm. In light of preventing the tip part of the shaft 6 from becoming excessively thick to thereby avoiding hardening of the tip part of the shaft 6, the external diameter X (mm) of the shaft tip is preferably equal to or less than 12.0 mm, more preferably equal to or less than 11.0 mm, and still more preferably equal to or less than 10.0 mm.

In FIG. 8, what is indicated by a both-oriented arrowhead N is the internal diameter (minimum internal diameter) of the screw member 40 in the cap 10. In light of enhancing the fastening strength of the screw mechanism, the internal diameter N is preferably equal to or greater than 7.0 mm, more preferably equal to or greater than 9.0 mm, and still more preferably equal to or greater than 10.0 mm. When the weight of the cap 10 is excessively increased, the position of the center of gravity of the head portion including the cap 10 is apt to be excessively high or get closer to the heel. In light of suppression of increase in the weight of the cap 10, the internal diameter N is preferably equal to or less than 20.0 mm, more preferably equal to or less than 18.0 mm, and still more preferably equal to or less than 16.0 mm.

In FIG. 8, what is indicated by a both-oriented arrowhead L is the length of the screw member 40 along the axial direction in the cap 10. In light of enhancing the fastening force of the screw mechanism, the length L is preferably equal to or greater than 5.0 mm, more preferably equal to or greater than 7.0 mm, and still more preferably equal to or greater than 10.0 mm. When the weight of the cap 10 is excessively increased, the position of the center of gravity of the head portion including the cap 10 is apt to be excessively high or get closer to the heel. In light of suppression of increase in the weight of the cap 10, the length L is preferably equal to or less than 21.0 mm, more preferably equal to or less than 17.0 mm, and still more preferably equal to or less than 15.0 mm.

In light of enhancing the sticking force of the shaft channel 46 of the inner member 8 and the shaft 6, it is preferred that the external diameter X (mm) of the tip of the shaft 6 and the internal diameter Y (mm) of the shaft channel 46 follow the following formula:

$$[Y-0.20]\leqq X\leqq Y.$$

In FIG. 4, what is indicated by a both-oriented arrowhead J is the insertion length of the shaft 6 with respect to the shaft channel 46. In light of enhancing the sticking force of the inner member 8 with the shaft 6, the insertion length J is preferably equal to or greater than 25 mm, more preferably equal to or greater than 30 mm, and most preferably equal to or greater than 35 mm. In light of preventing the inner member 8 from becoming excessively heavy, the insertion length J is preferably equal to or less than 50 mm, more preferably equal to or less than 45 mm, and most preferably equal to or less than 43 mm.

In FIG. 4, what is indicated by a both-oriented arrowhead P is the shaft length of the part that was stuck to the shaft channel 46 and is present inside the hosel hole 28. Support of the shaft channel 46 and shaft 6 by the hosel hole 28 renders the shaft 6 less likely to be deformed in the shaft channel 46, whereby the sticking of the shaft channel 46 with the shaft 6 becomes apt to be kept. In this respect, the length P is preferably equal to or greater than 25 mm, more preferably equal to or greater than 30 mm, and most preferably equal to or greater than 35 mm. In light of preventing the hosel member 22 and the inner member 8 from becoming excessively heavy, the length P is preferably equal to or less than 50 mm, more preferably equal to or less than 45 mm, and most preferably equal to or less than 43 mm.

As described in the foregoing, the golf club 2 realizes a golf club that has a simple structure in which a head and a shaft can be freely attached/detached. The screw member on the head side can be easily produced as long as the head has a common hosel. In other words, the present invention is applicable to the heads having a general structure, and is very versatile.

Figure 10:
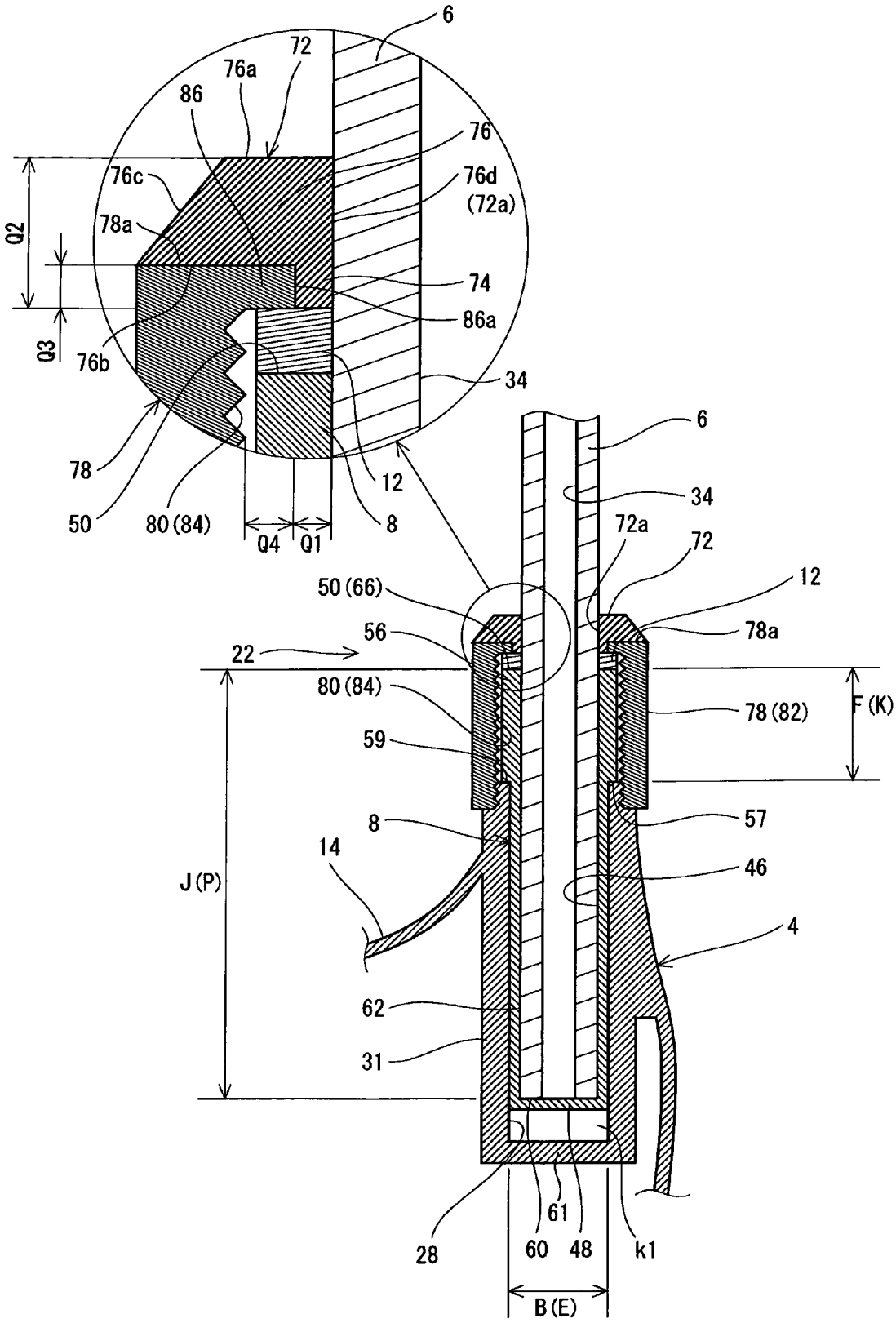
FIG. 10 shows a cross-sectional view of a golf club according to another embodiment of the present invention.
Figure 11:
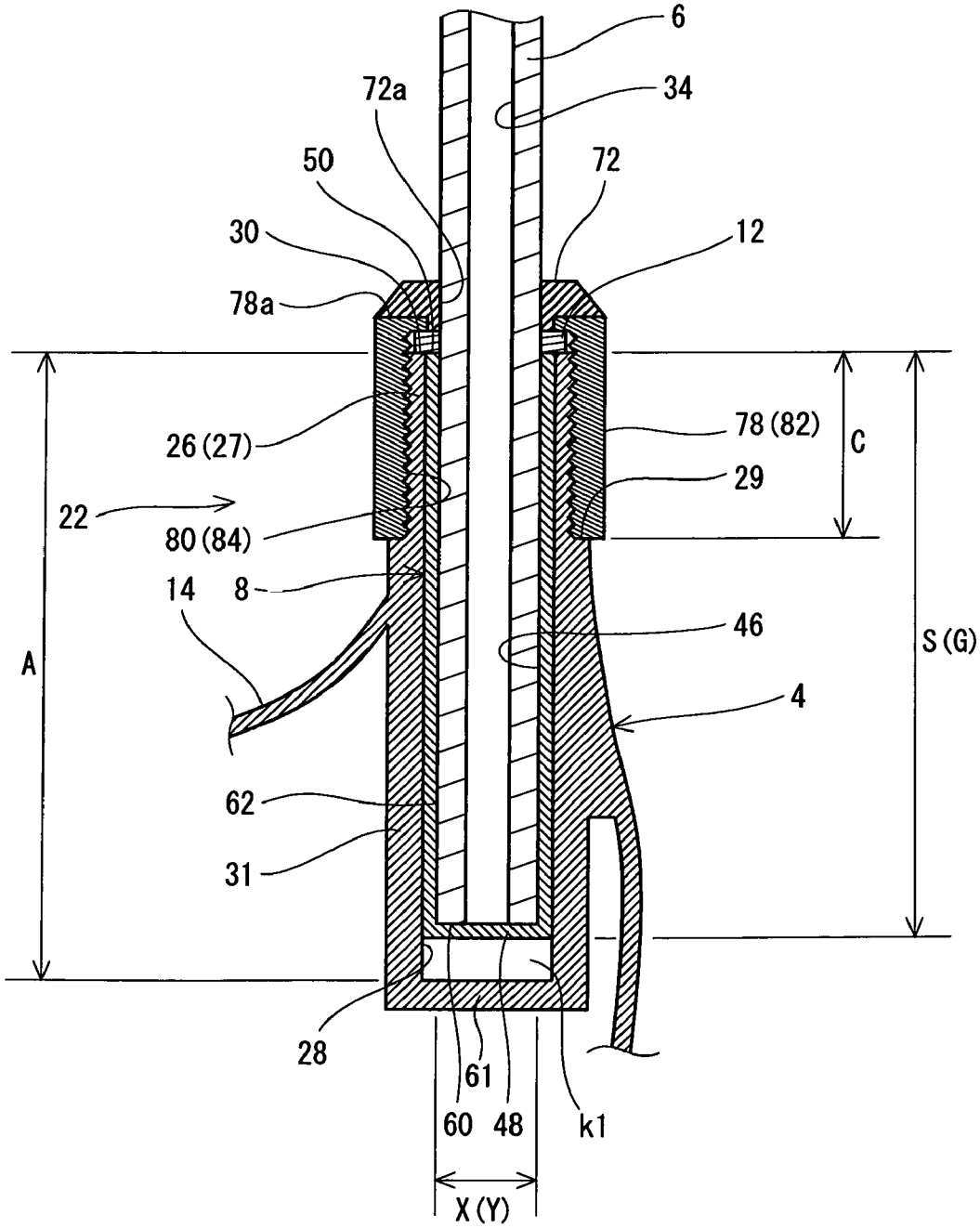
FIG. 11 shows a cross-sectional view of the golf club shown in FIG. 10 but taken along a line different from that in FIG. 10.

FIG. 10 and FIG. 11 show a cross-sectional view illustrating golf club 70 according to another embodiment. FIG. 10 shows a cross-sectional view which corresponds to the FIG. 4 of the golf club 2, while FIG. 11 shows a cross-sectional view which corresponds to the FIG. 5 of the golf club 2. The relationship of FIG. 10 and FIG. 11 is equivalent to that of FIG. 4 and FIG. 5. Unlike the aforementioned golf club 2, the golf club 70 has an adjacent member 72. As shown in the enlarged part of FIG. 10, the adjacent member 72 has an intervening portion 74 and a covering portion 76. The intervening portion 74 has an annular shape. The inner peripheral face of the intervening portion 74 is in contact with the outer peripheral face of shaft 6. The covering portion 76 has an annular shape. The covering portion 76 has a top face 76*a*, an inferior face 76*b*, an inclined face 76*c*, and an inner peripheral face 76*d*. The inner peripheral face 76*d* is in contact with the outer peripheral face of the shaft 6. The inner peripheral face 76*d* constitutes the inner peripheral face of the adjacent member 72 together with the inner peripheral face of the intervening portion 74. The inner peripheral face of the adjacent member 72 forms a through-hole 72*a* for inserting the shaft 6.

The top face 76*a* extends along the radial direction. The inferior face 76*b* also extends along the radial direction. The inclined face 76*c* extends between the top face 76*a* and the inferior face 76*b*. The inclined face 76*c* is a conic face. The external diameter of the inclined face 76*c* is smaller as it is measured closer to the top face 76*a*. The external diameter of the inferior face 76*b* is equal to the external diameter of the top face (top end face) 78*a* of the cap 78. The apparent shape of the covering portion 76 is similar to a ferrule, generally referred to.

The golf club 70 has a cap 78. Except for the presence of the adjacent member 72, and the shape of the cap, the golf club 70 is similar to the golf club 2 described above. The head 4, the shaft 6, the inner member 8, and the washer 12 in the golf club 70 are similar to those of the golf club 2. Such members and parts similar to those in the golf club 2 may not be explained ad libitum hereinbelow. In FIG. 10 and FIG. 11, the same reference signs denote the members and parts that are similar to those of golf club 2 will be FIG. 4 and FIG. 5.

The cap 78 has a circular cylindrical shape. The cap 78 has a hollow space therein. The cap 78 has an inner peripheral face 80 and an outer peripheral face 82. The outer peripheral face 82 corresponds to a circumference face. A screw member 84 is formed on the inner peripheral face 80. This screw member 84 is female threaded.

The cap 78 has internal extending portion 86 that extends more inwards than the screw member 84. The internal extending portion 86 is disposed upper side than the screw member 84. The internal extending portion 86 is disposed at the top end part of the cap 78. The internal extending portion 86 has an annular shape. The internal diameter M1 (not shown in the figure) of the internal extending portion 86 is smaller than the internal diameter N (not shown in the figure) of the screw member 84. As shown in FIG. 11, the screw member 84 of the cap 78 and the screw member 26 of the hosel member 22 are bound by thread connection. In other words, the screw member 84 and the screw member 26 are threadably engaged. In this manner, the cap 78 and the head 4 are connected by a screw mechanism. The outer peripheral face 82 of the cap 78 may have a noncircular cross-sectional shape. For example, the cross-sectional shape of the outer peripheral face 82 may have a straight line on at least a part thereof. For example, the cross-sectional shape of the outer peripheral face 82 may be a polygon such as a hexagon. By providing the outer peripheral face 82 having a noncircular cross-sectional shape, the cap 78 can be easily turned when the thread connection is allowed.

The difference of the cap 78 according to this embodiment from the cap 10 described above lies in the internal diameter of the internal extending portion 86. The internal diameter M1 of the internal extending portion 86 in the cap 78 is greater than the internal diameter M of the internal extending portion 44 in the cap 10. The cap 78 is substantially the same as the cap 10 except for the internal diameter of the internal extending portion.

The intervening portion 74 is positioned between the internal extending portion 86 and the shaft 6. In other words, the intervening portion 74 is positioned between the inner peripheral face 86*a* of the internal extending portion 86 and the external surface of the shaft 6. The covering portion 76 covers at least a part of the top face 78*a* of the cap 78. The covering portion 76 covers the whole of the top face 78*a*. The covering portion 76 and the intervening portion 74 are integrated. The covering portion 76 is integrally molded with the intervening portion 74. This integrated molding achieves high strength and durability of the adjacent member 72.

The engaging face 50 of the inner member 8 is indirectly engaged with the internal extending portion 86 via the washer 12. This engagement controls displacement of the inner member 8 upward in the axis direction with respect to the cap 78. This engagement prevents the inner member 8 from removing from the hosel hole 28.

The internal diameter M1 of the internal extending portion 86 is adjusted so as to engage with the engaging face 50 while permitting the presence of the intervening portion 74. The internal diameter M1 of the internal extending portion 86 is larger than the external diameter of the shaft 6 that is positioned opposite to the inner peripheral face 86*a*. The internal diameter M1 of the internal extending portion 86 is smaller than the external diameter of the engaging face 50. The internal diameter M1 of the internal extending portion 86 is smaller than the external diameter of the washer 12.

In this embodiment, the internal extending portion 86 and the engaging face 50 are indirectly engaged. More specifically, the internal extending portion 86 and the engaging face 50 are engaged via the washer 12. The internal extending portion 86 and the engaging face 50 may be directly engaged. The internal extending portion 86 may not have an annular shape. For example, the internal extending portion 86 may be a projection.

As the cap 78 and the hosel member 22 are allowed to be relatively rotated to screw the screw member 84 into the screw member 26, the cap 78 is moved downward with respect to the hosel member 22. This movement leads to getting the internal extending portion 86 close to the engaging face 50. Further screwing results in the state in which the internal extending portion 86 directly or indirectly presses the engaging face 50 downward. This pressing can secure fixation of the inner member 8 to the hosel member 22. As shown in FIG. 10 and FIG. 11, the golf club 70 of this embodiment is constructed such that the internal extending portion 86 can indirectly press the engaging face 50. In this embodiment, the internal extending portion 86 presses the engaging face 50 via the washer 12. The internal extending portion 86 may directly press the engaging face 50. The length, placement and the like of each screw member is arbitrarily designed such that the internal extending portion 86 presses the engaging face 50 directly or indirectly.

As described above, the inner member 8 and the shaft 6 are stuck. Therefore, when the inner member 8 is fixed on the head 4, the shaft 6 is fixed to the head 4. In addition, fixation of the head 4 with the shaft 6 can be easily released by loosening the screw mechanism.

The adjacent member 72 may be fixed to the cap 78. For example, the adjacent member 72 and the cap 78 may be adhered. When the adjacent member 72 is fixed to the cap 78 beforehand prior to assembly of the golf club 70, assembly of the golf club 70 can be facilitated. Alternatively, the adjacent member 72 may not be fixed to the cap 78.

The adjacent member 72 may be fixed to the shaft 6. For example, the adjacent member 72 may be fixed to the shaft 6 by pressing the shaft 6 into the through-hole 72*a* of the adjacent member 72. In this case, the diameter of the through-hole 72*a* may be the same as the external diameter Ds (not shown in the figure) of the shaft 6 at a position to be inserted into this through-hole 72*a*, or may be slightly less than the external diameter Ds of this shaft 6. The adjacent member 72 may be adhered to the shaft 6. The adjacent member 72 may not be fixed to the shaft 6. It is acceptable that the adjacent member 72 is fixed either the shaft 6 or the cap 78.

In FIG. 10, what is indicated by a both-oriented arrowhead Q1 is the thickness in the radial direction of the intervening portion 74. This thickness Q1 is measured along the radial direction. In light of the strength, the thickness Q1 is preferably equal to or greater than 0.5 mm, more preferably equal to or greater than 0.7 mm, and still more preferably equal to or greater than 1.0 mm. In light of increase in the length Q4 described later to enhance the strength of the cap 78, the thickness Q1 is preferably equal to or less than 3.0 mm, more preferably equal to or less than 2.5 mm, and still more preferably equal to or less than 2.0 mm.

In FIG. 10, what is indicated by a both-oriented arrowhead Q2 is the maximum length of the covering portion 76. This length Q2 is measured along the axial direction. In light of the strength, the length Q2 is preferably equal to or greater than 2.0 mm, more preferably equal to or greater than 2.5 mm, and still more preferably equal to or greater than 3.0 mm. In light of the weight saving of the covering portion 76, the length Q2 is preferably equal to or less than 10 mm, more preferably equal to or less than 6.0 mm, more preferably equal to or less than 5.0 mm, and still more preferably equal to or less than 4.0 mm.

In FIG. 10, what is indicated by a both-oriented arrowhead Q3 is the thickness in the axial direction of the internal extending portion 86. This thickness Q3 is measured along the axial direction. In light of the strength of the internal extending portion 86, the thickness Q3 is preferably equal to or greater than 0.5 mm, more preferably equal to or greater than 1.0 mm, and still more preferably equal to or greater than 1.5 mm. In light of the weight saving of the cap 78, the thickness Q3 is preferably equal to or less than 4.0 mm, more preferably equal to or less than 3.0 mm, and still more preferably equal to or less than 2.0 mm.

In FIG. 10, what is indicated by a both-oriented arrowhead Q4 is the length in the radial direction of the internal extending portion 86. This length Q4 is measured along the radial direction. In light of the strength of the internal extending portion 86, the length Q4 is preferably equal to or greater than 2.0 mm, more preferably equal to or greater than 3.0 mm, and still more preferably equal to or greater than 4.0 mm. In light of the weight saving of the cap 78, the length Q4 is preferably equal to or less than 8.0 mm, more preferably equal to or less than 7.0 mm, and still more preferably equal to or less than 6.0 mm.

As the assembly procedure of the golf club 70, the following procedure 3, procedure 4 and procedure 5 may be illustrated.

[Assembly Procedure 3]

This procedure includes the following steps (1a) to (6a)

(1a) An adhesive is applied between the adjacent member 72 and the shaft 6 while inserting the shaft 6 through the adhesive adjacent member 72.

(2a) The shaft 6 is inserted through the cap 78 and the washer 12.

(3a) The shaft is inserted into the shaft channel 46 of the inner member 8, and the shaft 6 and the inner member 8 are joined by an adhesive or the like.

(4a) The inner member 8 is inserted into the hosel hole 28.

(5a) The cap 78 is screwed with the hosel member 22.

(6a) The adhesive applied in the step (1*a*) is cured.

[Assembly Procedure 4]

This procedure includes the following steps (1b) to (5b)

(1b) The shaft 6 is pressed into the adjacent member 72.

(2b) The shaft 6 is inserted into the cap 78 and washer 12.

(3b) The shaft is inserted into the shaft channel 46 of the inner member 8, and the shaft 6 and the inner member 8 are joined by an adhesive or the like.

(4b) The inner member 8 is inserted into the hosel hole 28.

(5b) The cap 78 is screwed with the hosel member 22.

[Assembly Procedure 5]

This procedure includes the following steps (1c) to (5c)

(1c) The adjacent member 72 is adhered to the cap 78 by an adhesive.

(2c) The shaft 6 is inserted into the cap 78 to which the adjacent member 72 was adhered, and the washer 12.

(3c) The shaft is inserted into the shaft channel 46 of the inner member 8, and the shaft 6 and the inner member 8 are joined by an adhesive or the like.

(4c) The inner member 8 is inserted into the hosel hole 28.

(5c) The cap 78 is screwed with the hosel member 22.

In addition to these procedures 3 to 5, an assembly procedure according to the aforementioned assembly procedure 2 can be also adopted.

In the case of the assembly procedure 4, the shaft 6 is fixed to the adjacent member 72 by pressing thereinto, however, the position of this fixation must agree with the position of the adjacent member 72 in the finally assembled state. This adjustment for allowing the positions to be agreed requires high accuracy. In light of ease in assembly, it is preferred that the shaft 6 is not pressed into the through-hole of the adjacent member 72. In light of ease in assembly, it is preferred that the adjacent member 72 be adhered to the cap 78 or the shaft 6. The assembly procedure 5 enables the adjacent member 72 and the cap 78 to be integrally dealt with following the step (2). In this respect, it is more preferred that the adjacent member 72 be adhered to the cap 78.

Impact force generated upon hitting can result in stress concentration on the top face of the cap. The adjacent member 72 can moderate this stress concentration. According to the embodiment (golf club 2) shown in FIG. 4, the inner peripheral face of the internal extending portion 44 abuts the external surface of the shaft 6. To the contrary, the intervening portion 74 is present between the internal extending portion 86 and the shaft 6 according to the embodiment (golf club 70) shown in FIG. 10. This intervening portion 74 prevents the edge of the top face 78*a* of the cap 78 from abutting the shaft 6, whereby the stress concentration can be moderated. This moderation of the stress concentration may improve the durability of the shaft 6.

The cap 78 is threadably engaged with the head 4. Therefore, high integrity of the head 4 and the cap 78 is achieved. Accordingly, even though the shaft 6 is bent, the cap 78 is strongly confined by the head 4. Accordingly, the cap 78 is less likely to move following the shaft 6. In contrast, low integrity of the head 4 and the adjacent member 72 is attained. Thus, the adjacent member 72 is apt to move following the bending of the shaft 6. Therefore, the presence of the adjacent member 72 can moderate the stress concentration. Moreover, the presence of the covering portion 76 increases the length of the through-hole 72*a* of the adjacent member 72. Accordingly, the adjacent member 72 is apt to move following the movement of the shaft 6. Therefore, the stress concentration can be even more moderated by the presence of the covering portion 76.

As described above, there is the covering portion 76 in the adjacent member 72. Due to the presence of the covering portion 76 in addition to the intervening portion 74, contact area of the adjacent member 72 with the shaft 6 can be increased. Enlargement of the contact area can still more moderate the stress concentration.

Selection of the material of the adjacent member 72 can improve the moderating effect of the stress concentration. In light of improving the effect to moderate the stress concentration, the material of the adjacent member 72 is preferably a nonmetal. In light of the processability and flexibility, the base material of the adjacent member 72 is preferably cellulose acetate, cellulose nitriate, an ABS resin and polypropylene, and cellulose acetate is more preferred.

In light of the strength, Young's modulus Yg of the material of the adjacent member 72 is preferably equal to or greater than 0.1 GPa, more preferably equal to or greater than 1.0 GPa, and even more preferably equal to or greater than 3.0 GPa. In light of moderation of the stress concentration, the Young's modulus Yg is preferably equal to or less than 20 GPa, more preferably equal to or less than 19 GPa, and still more preferably equal to or less than 15 GPa.

Figure 12:
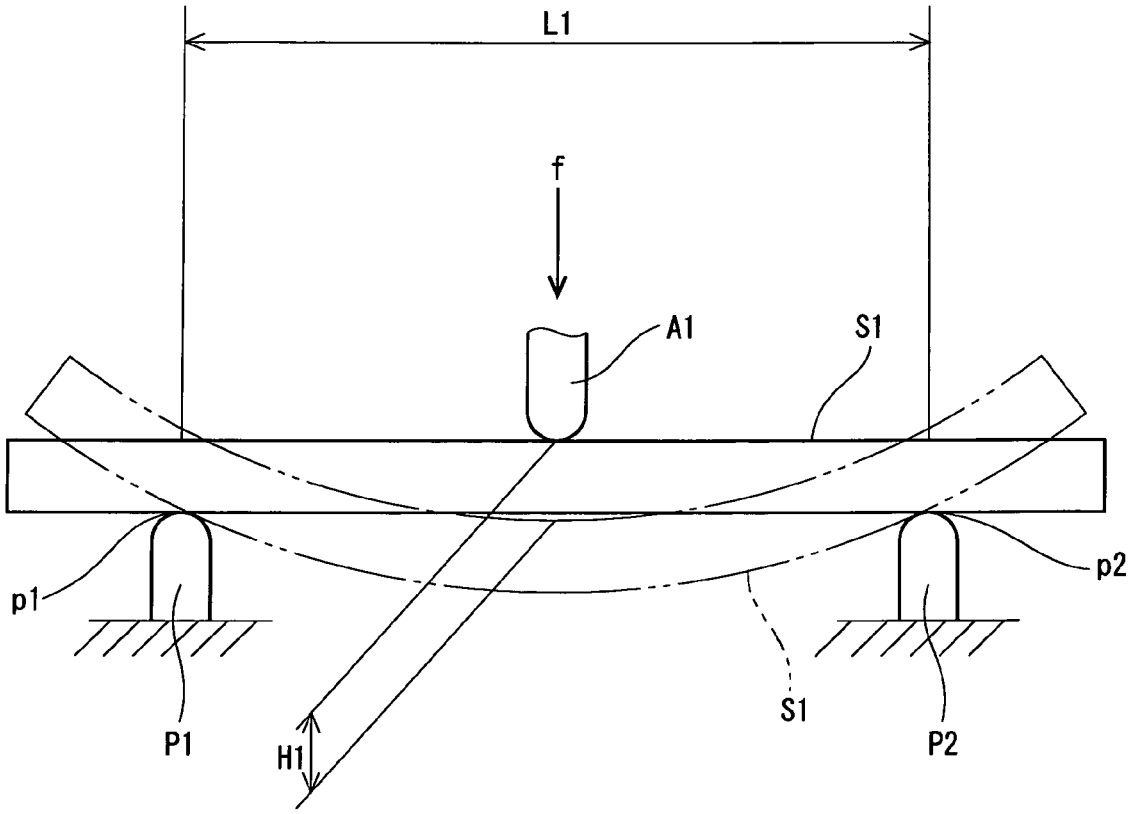
FIG. 12 shows an explanatory view for illustrating a method for determining Young's modulus.

A method for determining the Young's modulus Yg is shown in FIG. 12. A test piece S1 is a test piece No. 3 in accordance with the bend test piece for metallic materials of JIS Z2204. The test piece S1 has a rectangular cross-sectional shape. With respect to the size of this test piece S1, the width W is 20 mm, while the thickness T is 3.0 mm. The length of the test piece S1 is 150 mm. The test piece S1 is placed on two supports P1 and P2 with a span L1 of 30 mm. The test piece S1 is horizontally placed. The test piece S1 is placed such that longer sides in the rectangle of the cross section are parallel. A load f of F (N) is allowed to act at a position that yield two halves between the support points p1 and p2, whereby the flexible volume H1 (mm) is measured. The load f is 100 N. A load f is imparted by an indenter A1. As a test apparatus, "Intesco (load cell: 2 tons)" manufactured by INTESCO Co., Ltd. is used. The measurement is carried out according to JIS Z2248. Young's modulus Yg (GPa) is derived according to the following formula.

$$Yg=[(L1^3\times F)/(4\times W\times T^3\times H1)]\times 10^{-3}$$

EXAMPLES

Hereinafter, advantages of the present invention will be further clarified by way of Examples, however, the present invention should not be construed as being limited based on the description of the Examples.

In a similar manner to the golf club 2 described above, a head, a shaft, an inner member, a cap and a washer were produced. The structure and shape of these were the same as those of the aforementioned embodiment. The head was integrally molded by lost wax precision casting. The material of the head was Ti-6A-4V. The head had a weight of 170 g. The material of the inner member was an aluminum alloy. The inner member had a weight of 2.0 g. The material of the cap was material an aluminum alloy. The cap had a weight of 3.0 g. The material of the washer was an aluminum alloy. The washer had a weight of 0.1 g. These were assembled according to the procedure described above to obtain a golf club shown in FIG. 1. As an adhesive for adhering the shaft and the inner member, "Esplen" manufactured by Tohritu Kasei Kohgyo Co., Ltd. was used. In this Example, the depth A was 43.0 mm; the pore size B was 10.0 mm; the length K was 10.0 mm; the maximum diameter D was 12.0 mm; the external diameter E was 9.9 mm; the length F was 10.1 mm; the length G was 41.0 mm; the internal diameter M was 9.1 mm; the internal diameter N was 14.0 mm; and the length L was 13.0 mm. Also, the washer had an internal diameter of 9.3 mm; the washer had an external diameter of 13.9 mm; the washer had a thickness in the axial direction of 1.0 mm. The shaft tip had an external diameter X (mm) of 8.9 mm; the shaft channel had an internal diameter Y was 9.0 mm; and the insertion length J and the length P were 40.0 mm. The inner member 8 had an insertion length S of 41.0 mm. When balls were hit with this golf club, sticking of the head with the shaft was kept.

The description hereinabove is merely for an illustrative example, and various modifications can be made in the scope not to depart from the principles of the present invention.

The present invention can be applied to any of golf clubs including wood golf clubs, iron golf clubs and the like.

What is claimed is:

1. A golf club comprising a shaft, a head, an inner member, a cap, and an adjacent member, wherein the head has a hosel member;

the hosel member has a screw member formed on the outer peripheral face thereof, and a hosel hole;

the cap has a top face, a screw member formed on the inner peripheral face thereof, and an internal extending portion that extends more inwards than the screw member;

the screw member of the cap and the screw member of the hosel member are bound by a threaded connection;

the inner member has a shaft channel provided so as to open on the top end side, and an engaging face;

at least a part of the inner member is inserted in the hosel hole;

the shaft and the shaft channel are secured by adhesion and/or fitting;

the internal extending portion is directly or indirectly engaged with the engaging face, and the engagement controls upward displacement of the inner member with respect to the hosel hole; and the adjacent member has an intervening portion that is positioned between the internal extending portion of the cap and the shaft, and a covering portion that is integrated with the intervening portion and covers at least a part of the top face of the cap.

2. The golf club according to claim 1, wherein the threaded connection enables the internal extending portion to press the engaging face directly or indirectly in a downward direction.

3. The golf club according to claim 1, wherein the hosel member has a chipped portion extending downward from a top end face thereof; and the inner member has an engaging protruding part engaged with the chipped portion.

4. A golf club comprising a shaft, a head, an inner member and a cap, wherein the head has a hosel member;

the hosel member has a screw member formed on the outer peripheral face thereof, and a hosel hole;

the cap has a screw member formed on the inner peripheral face thereof, and an internal extending portion that extends more inwards than the screw member;

the screw member of the cap and the screw member of the hosel member are bound by a threaded connection;

the inner member has a top end face, a shaft channel provided so as to open on the top end side, and an engaging face, wherein the top end face of the inner member corresponds to the engaging face;

at least a part of the inner member is inserted in the hosel hole;

the shaft and the shaft channel are secured by adhesion and/or fitting;

the internal extending portion is directly or indirectly engaged with the engaging face, and the engagement controls upward displacement of the inner member with respect to the hosel hole;

wherein the inner member has an engaging protruding part provided at the top end portion thereof, a top end face of the protruding part corresponds to a part of the engaging face, and the top end face of the engaging protruding part plays a role in widening the engaging face; and wherein said inner member has a plurality of engaging protruding parts where a space is between each of said engaging protruding part with an adjacent of said engaging protruding part on said top end side on said engaging face.

5. The golf club according to claim 4, wherein the inner member is not visually recognized from the outside.

6. A golf club comprising a shaft, a head, an inner member and a cap, wherein the head has a hosel member;

the hosel member has a screw member formed on the outer peripheral face thereof, and a hosel hole;

the cap has a screw member formed on the inner peripheral face thereof, and an internal extending portion that extends more inwards than the screw member;

the screw member of the cap and the screw member of the hosel member are bound by a threaded connection;

the inner member has a shaft channel provided so as to open on the top end side, and an engaging face;

at least a part of the inner member is inserted in the hosel hole;

the shaft and the shaft channel are secured by adhesion and/or fitting;

the internal extending portion is directly or indirectly engaged with the engaging face, and the engagement controls upward displacement of the inner member with respect to the hosel hole;

the hosel member has a chipped portion extending downward from a top end face thereof;

the inner member has an engaging protruding part engaged with the chipped portion; and the engaging protruding part has a length along the axial direction no less than the chipped portion length along the axial direction and wherein said inner member has a plurality of engaging protruding parts where a space is between each of said engaging protruding part with an adjacent of said engaging protruding part on said top end side on said engaging face.

* * * * *